US005267883A

United States Patent [19]

Gudmundsen

[11] Patent Number: 5,267,883

[45] Date of Patent: Dec. 7, 1993

[54] INTERNAL WATER-JET BOAT PROPULSION SYSTEM

[76] Inventor: Richard A. Gudmundsen, 12052 Larchwood Ln., Santa Ana, Calif. 92705

[21] Appl. No.: 809,929

[22] Filed: Dec. 18, 1991

[51] Int. Cl.[5] ..... B63H 11/02

[52] U.S. Cl. ..... 440/38; 440/41; 440/47

[58] Field of Search ..... 440/13, 17, 18, 19, 440/21, 23, 38, 40, 41, 42, 43, 47; 60/221, 222

[56] References Cited

U.S. PATENT DOCUMENTS

| | | | |
|---|---|---|---|
| 1,281,643 | 10/1918 | Olsen | 440/18 |
| 3,183,878 | 5/1965 | Aschauer | 440/38 |
| 3,479,674 | 11/1969 | Beymer | 440/38 |
| 3,556,039 | 1/1971 | Sfredda | 440/18 |
| 4,461,620 | 7/1984 | Brachet | 440/38 |
| 4,541,357 | 9/1985 | Stanton | 440/38 |
| 4,565,530 | 1/1986 | Espenhain | 440/18 |

*Primary Examiner*—David M. Mitchell

*Assistant Examiner*—Stephen P. Avila

[57] ABSTRACT

This is a water-jet propulsion system employing a cyclic air-pump to induce a cyclic reduced-pressure inside a vacuum-chamber which has front and rear valves, the front facing the predominant direction of travel. The front valve opens near the start of a "pump down" portion of the cycle to allow a jet of water to be admitted at the bottom of said boat from the "rest system" outside, into the less-than-atmospheric-pressure interior, the front or intake valve closing after the "jet-slug" is fully formed. The internal pressure changes so that when said jet-slug reaches said exit port, said chamber pressure is atmospheric and the opened exit port valve allows the water-slug to exit the chamber just prior to the beginning of a new cycle. Friction and pumping losses are minimal as the water jet is not in contact with walls over most of its trajectory, and said pump is pumping air. Low final water-velocity with respect to the rest system, high volume flow, leads to high propulsion efficiency.

1 Claim, 2 Drawing Sheets

INTERNAL WATER-JET BOAT PROPULSION SYSTEM

OVERALL-OBJECTIVE OF THE INVENTION

The present invention relates to the propulsion of surface or undersea boats and in particular to a jet-propulsion system which does not have the frictional and turbulence losses associated with current water-jet or water-propeller propulsion systems.

BACKGROUND THEORY

The force generated by a "propulsion-engine", (a device for generating a force for propelling a vehicle through a fluid medium), can operate using forces derived from two different physical effects, but leading to the same overall result. This can be illustrated using two simple examples.

Suppose a man is in a boat. He now takes a bucket and dips some water from the side of the boat and throws the water from the bucket in a rearward direction. The act of throwing exerts a force on the bucket, (man-boat system), due to "reaction" in delivering "momentum" to the water. This is the principle employed in current propeller and jet-boat propulsion systems.

In our second example, which forms the basis of the present invention, suppose that we had a pipe mounted under the water and closed at both ends forming a chamber. We now evacuate some of the air from the chamber. Note that the atmospheric pressure minus the internal pressure, will be pushing against each end of the chamber in equal and opposite directions. There will be no net thrust on the chamber. At some time $t_1$ we open a port, (a bit smaller in diameter than the pipe), at the front of the pipe. Water will be forced into the pipe by the atmospheric pressure in a flying jet into the partial-vacuum. Well before the front of the flying jet of water reaches the other end, we close the intake port and allow the slug of water to continue down the pipe through the partial vacuum. Just before it gets to the end we admit air into the pipe to bring it back to the pressure outside the pipe, and open the back end of the pipe to let the water fly out. Note that in this case, the actual force pushing against the chamber is the water pressure pushing against the back of the pipe minus the differential pressure across the intake orifice, times the orifice area. If we are at zero speed with respect to the water this will be simply the pressure in the water minus the inside pressure, times the orifice area.

For moving cases, the calculation is more complex. The "stagnation" pressure of the water with respect to the moving boat is $P_s=\frac{1}{2}\rho V_B^2$, (the differential pressure required to squirt a jet of water out of a hole at a velocity $V_B$). To this we add the differential pressure $(p_o-p)$. This yields the effective pressure differential. The velocity of the incoming water with respect to the boat is then $$V_{Wj}=\sqrt{V_B^2+\frac{2(p_o-p)}{\rho}}$$

where $\rho$ is the density of the water.

The mass-flow-rate of the incoming water $dm/dt=A\rho V_{wj}$ Kg/sec. and the force is the mass rate times the velocity of the jet with respect to the static water.

$$F=\rho A\left[\frac{2(p_o-p)}{\rho}+V_b^2-V_B\sqrt{\frac{2(p_o-p)}{\rho}+V_B^2}\right]$$

Thus while the actual force is due to the differential-pressure on the back of the chamber, we compute it using the water-jet momentum relationship.

It is well known that the propulsion efficiency is highest for a system which ejects the "working water", i.e. the fluid moved by the propulsion system with respect to the "rest" water, at the lowest possible velocity with respect to the water through which the boat is moving, (the "rest" coordinate system). For an "ideal" system, the propulsion efficiency, (ratio of power provided by the system to thrust the boat divided by the power from the engine), is given by the simple equation:

$$\eta_p=\frac{2V_B}{V_B+V_{WJ}}$$

Here $V_B$ is the boat velocity with respect to the rest water, and $V_{wj}$ is the velocity of the water jet with respect to the boat.

The thrust of the propulsion system as we have seen, is the product of the mass rate of flow of the working water involved in the propulsion system, times the velocity of the ejected water with respect to the rest system. Clearly systems with high mass-flow rate and low velocity-differential are desirable from a "propulsion efficiency" point of view.

When a fluid such as water is constrained to flow inside a tube, the walls of the tube tend to impede the flow through "surface friction". The most commonly used mathematical formulation of this effect is the head-loss due to frictional flow. This is given by the formula:

$$\Delta h=f\frac{L}{D}\ \frac{V^2}{2g}$$

In current jet-boats, the fluid velocity is very high through the pumping system, and the corresponding losses due to friction and turbulence i.e. "flow losses", are major detriments to efficient operation.

For smooth pipes the parameter f is of the order of 0.01 to 0.02 depending on the Reynolds number of the system. L is the length of the pipe and D is the pipe "hydraulic" diameter.

In addition to such duct frictional losses, the high specific speed pumps used is current jet boats are low in "pumping efficiency" due to the other frictional losses associated with the swirling motions inherent in the pumping means involved.

Propeller driven systems induce large vortex motions in the water with attendant energy losses. Propellers on small boats generally operate at high peripheral speed approaching cavitation velocities. This results in large surface-friction losses. In addition there is a drag due to the propeller effective cross-sectional area which is also a major loss-factor.

The Significant Technical Advantages of this Invention are:

(1) Large mass-flow and low relative-velocity flow in an "internal jet" propulsion system yielding high "propulsion efficiency".

(2) Minimization of the internal-flow-losses in the system by having virtual non-contact flow of the internal water jet through the pumping means.

(3) A high pump energy-efficiency, through the use of air, (rather than water), as the working fluid in the mechanical pump. The work in this system is done by the air-pump.

FIELD OF THE INVENTION

U.S. 440/17; 440/18; 440/38; 440/42; 440/47; 114/151; 60/231

BACKGROUND ART

A. A CLASSIFICATION SCHEME FOR THE ART

The use of water-pumps to produce jets of water for boat-propulsion is old and extensive. The pumps might be classed into the following categories depending on the type and the implementations.

I. Internal Centrifugal Pumps

Ruthuem; U.S. Pat. No. 6,468 "Ship Propeller" May 1849.

Krautkremer et al; U.S. Pat. No. 4,419,082 "Water-Jet Drive Mechanism for Driving and Controlling of Particularly Shallow-Draught Watercraft" December 1983

II. Reciprocating Pumps

Jackson; U.S. Pat. No. 385,183 "Marine Propulsion" June 1888.

Beymer; U.S. Pat. No. 3,479,674 "Water Shoe" November 1969.

Stredda; U.S. Pat. No. 3,556,039 "Propulsion Device" January 1971.

III. Ducted Propeller Pumps

De Spuches; U.S. Pat. No. 1,771,402 "Method of Propulsion by Suction and Repulsion" June 1928.

Lynch; U.S. Pat. No. 2,268,155 "Boat Construction" May 1940.

Krautkremer; U.S. Pat. No. 4,411,630 "Water-Jet Drive Mechanism for the Driving of Watercraft" October 1983.

VI. Mechanical "Throwing" Pumps

Brachet; U.S. Pat. No. 4,461,620 "Propulsion Device and a Method of Propelling a Nautical Vessel" July 1984.

V. Air-Jet Entrainment Pumps

Schell; U.S. Pat. No. 3,171,379 "Hydro-Pneumatic Ramjet" July 1960.

VI. Air-Lubricated Jet-Pumps

Haynes: U.S. Pat. No. 4,979,917 "Marine Propulsion Device with Gaseous Boundary Layer for a Thrust Jet Flow Stream Exhibiting Stealth and Ice Lubrication Properties" December 1990.

The present invention adds a seventh category to the list:

VII. Internal-Jet Pneumatic-Hydraulic Pumps

Definitions of Terms

WATER LINE: The surface of the water outside the boat. It is generally lower at the stern than at the prow due to the hydraulics of the moving boat.

STATIC WATER: The water in the lake, river, or sea through which the boat is moving. It serves as the velocity reference frame.

JET-SLUG OR WATER SLUG: A term used here to describe the flying segment of water having a cross-section defined approximately by the area of the intake port or valve, and having a length depending on the cycle chosen, but always less than the flight-chamber length. Said jet-slug flies through the air.

INTERNAL WATER JET: A term in the title meant to convey the idea that the jet of water is formed inside a structure, i.e. "internal" to the mechanism.

FLIGHT CHAMBER: The gas tight chamber through which the jet-slug of water flies ballistically through the air.

AIR PRESSURE: The absolute pressure in the outside air or the air in the flight chamber, 0 being a complete vacuum.

AIR PUMP: A mechanical means connected to the engine which either reduces the air pressure in the flight chamber in which energy is conveyed from the engine and stored as potential energy in the gas (air), in the system, or raises the air pressure in the flight chamber back to atmospheric pressure and in so doing conveys a portion of the stored potential energy in the gas (air) in the flight-chamber back to the engine. The difference between the two energy transfers is the energy transferred to the jet-slug of water to induce thrust.

INTAKE PORT VALVE OR INTAKE VALVE: The controlled valve which is opened or closed by a valve actuator at a proper time to admit water from beneath the boat bottom near the front of the flight chamber, said front being that end facing the prow of the boat.

EXIT PORT VALVE OR EXIT VALVE: The controlled valve which is opened or closed by a valve actuator. It is opened at a time when the flight-chamber air-pressure is approximately equal to the atmospheric pressure in the air around the boat. Alternately it may be opened by the force of the water-jet slug impinging against it.

VALVE ACTUATOR: A mechanical or magnetic means which opens or closes a valve upon command.

CYCLE: The cyclic operation of the propulsion system consisting of:

(1) The "pump-down" in which the air-pump reduces the air pressure in the sealed flight chamber below atmospheric pressure.

(2) The "admission" portion of the cycle in which the intake port valve is open and a jet-slug of water is being formed. The air-pressure in the flight chamber is less than atmospheric all during the admission portion of the cycle.

(3) The "pump-up" which starts just after the intake port valve has been closed and the jet-slug is fully formed. During this portion of the cycle, the pressure of the atmospheric air is doing work against the pumping means and the mechanical system reclaims a portion of the potential energy stored in the gas (air), in the flight chamber and converts it back to kinetic energy. At the conclusion of the pump-up, the difference in air pressure between the flight chamber and the outside air is negligible.

(4) The "exit" portion of the cycle is that portion after the exit port valve has been opened and the free-flying jet-slug of water is free flying out of the flight chamber into the outside air behind the stern of the boat.

CONTROLLER MEANS: An electronic computer or processor having stored instructions and programs capable of controlling and operating the system under instructions from the human operator, or alternatively a mechanical means of levers, cams, and other mechanical structures to perform the task of the electronic computer and system program.

FREQUENCY AND PHASE SENSOR: A sensor which measures the phase of the rotating shaft on the air-pump to determine its phase and frequency of rotation.

BOAT SPEED SENSOR: A sensor designed to provide an output proportional to the velocity of the boat through the water.

REVERSE THRUST VANE: A specially shaped vane which can be positioned so as to intercept the exiting water jet slug so as to turn its trajectory by approximately 180 degrees in the plane of the static water surface. It is normally stowed in a convenient position at the stern of the boat.

B. DISCUSSION OF THE PRIOR ART

In the early mechanizations of pumping means for propulsion, little attention was paid to the effect of frictional losses in the ducts and pumps. Brachet teaches the principle of loss reduction by using a propeller to segment and accelerate a free-flying jet of water created by the dynamic pressure at the intake of the system caused by the forwards motion, but still has the losses in the intake portion of the system and in the angular dispersion of the "throwing system". Krautremer teaches the minimizing of duct frictional loss by minimizing the length of the duct. Schell uses an air-pump to supply the air in a fuel-burning underwater ram-jet. Haynes teaches the principle of reducing the friction losses on flying jets by surrounding them with a gas sheath. Non of these teach the principle of creating an internal jet of water flowing into a cycled pneumatically reduced-pressure chamber to induce and propel a free-flying jet of water.

SUMMARY OF THE INVENTION

A long thin gas-tight chamber nominally filled with air called the "flight chamber" is constructed in the bottom of a boat. The flight chamber for a small motor boat has a length of about one or two meters, a width equal to a large fraction of the total boat width, and a height of the order of 10 to 20 percent of the chamber length. The flight chambers for larger ships are much larger.

A low-frequency large-volume reciprocating air-pump, (most likely a large diaphragm pump for a small motor boat), is mounted on the top, or to the side, front, or rear of the flight chamber and is driven through a speed-reduction mechanism by an engine.

At the first portion of a "cycle", which we call "pump-down", the pump reduces the air pressure in the flight chamber below atmospheric pressure. At a chosen time or pressure, a valve called the "intake port valve" opens and begins to admit intake water from beneath or from the side of the boat through a very short duct, or hole in a diaphragm, into the front of the chamber forming a free-flying water-jet directed through the air in the flight-chamber towards the exit port.

During the flight of the increasingly long "slug" of water, the pump is continuing to increase the internal volume of pump-plus-flight chamber and is working against atmospheric pressure minus the internal reduced-pressure. This section of the cycle is called the "admission" portion of the cycle. The velocity of the intake water into the partially evacuated flight chamber is higher than that of the moving or static boat because the differential pressure ($p_c - p_o$) is negative. Here $p_c$ is the pressure inside the chamber, and $p_o$ is the static pressure in the water just outside the intake port valve opening.

At a chosen time or pressure later, the water intake valve closes. The now full-sized jet slug of water continues in a ballistic trajectory through the reduced-pressure air towards the rear of the flight chamber. For a typical system, the slug of water would have a length of perhaps 60% to 70% of the chamber length. During the latter part of this flight time called the "pump-up" portion of the cycle, the atmospheric pressure is doing work on the piston and we are converting PV potential energy back into mechanical energy.

The air pressure inside the flight chamber reaches atmospheric pressure well before the end of the cycle because of the presence of the water slug volume which is in addition to the constant mass of "working" air within the chamber. At this time, the "exit port valve" at the rear of the flight chamber opens just in time to allow the front of the flying slug of water to exit from the chamber. It is advantageous to admit the intake water in such a way as to direct its trajectory to the exit port which is above the water line just behind the stern of the boat. By this means, outside water cannot interfere with the exiting jet of water. We do this with a small cost in pumping power.

The time-of-exit of the back-end of the flying slug of water, and the subsequent closure of the exit port valve occurs prior to the beginning of a new cycle. This last section of the cycle where the pressure is constant at atmospheric pressure, is called the "exit" portion of the cycle.

While the boat is moving with respect to the static water, the slug of water is ejected at a negative velocity only a few meters per second larger than that of the boat, but has a large mass. Thus the momentum added to the slug of water with respect to the boat is large despite its low exit speed. This momentum times the cycle frequency of the pump will determine the average thrust applied to the boat. A typical cycle time is of the order of a few hertz.

The frequency is a function of the speed of the boat with respect to the static water, as is the average thrust. When the boat is starting out at zero or very low speed, the thrust is large and accelerates the boat rapidly. The thrust is maximum at zero speed and generally decreases slowly with increased velocity. The thrust can be varied over a large range by variation of the timing of the opening and closing of the valves, and the degree to which they are opened.

Because the velocity of the exiting slug of water with respect to the static water through which the boat is moving is small, the efficiency of the propulsion system is high. In addition, there is virtually no frictional loss in the pumping-system due to water flow through intake ports, pumps, and exit ports. The "working fluid" of the pump is air with its very low viscosity.

It should be noted that in some cases it may be impractical to design the flight chamber shape to be optimum for all values of boat speed. Here the shape is made optimum for the boats cruising-speed and for this speed the flying jet does not touch the walls to any appreciable extent. However, for lower or higher boat speeds, the flying jet is forced at some portions of the walls to follow the duct trajectory, and there are some wall-friction losses which result.

It may be advantageous is certain cases to make the walls of the chamber "conformable" through mechanical means. In this case the shape is changed as the speed changes.

For very high efficiency systems, the walls of the flight chamber are built far enough away from the flying jet at all speeds so as to not be in contact. Here an adjustable intake port directs the jet to pass through the exit port with various trajectories.

In still another case, the velocity of the jet of water into the flight chamber is kept constant by varying the area of the inlet port. In this case, the trajectory is constant.

In order to drive the boat in reverse or to stop it quickly, a special vane called the "reverse thrust" vane is lowered into the exiting jet of water at the stern so as to re-direct it approximately 180 degrees around the sides of the boat towards the boats prow.

A certain amount of water will usually be left in the chamber after the main slug has gone, due to spray and other effects. A small water-pump can be employed to remove this residual so as to prevent build-up of such water within the flight-chamber.

As the slug of water is exiting, the exit port opening is larger than the slug cross-section. This will allow air to flow either way to keep the inside pressure near atmospheric pressure. But since the flying jet will tend to entrain air, it may be advantageous to employ a small air-blower to "blow-out" the chamber while the slug of water is exiting.

In the case of submarines, the system can be employed by exiting the water-jet-slug into an air-chamber on the bottom of the submarine which is open on the bottom and formed in such a shape so as to have the water surface inside the chamber close to the bottom of the vessel. After the water-slug has landed on the water surface in the chamber, the momentum will cause the water in the chamber to flow backward to propel the submarine.

An additional feature of this invention is the potential quietness of the propulsion-system. With a muffled engine-exhaust and vibration damping of the mechanical parts, a very quiet boat is possible due to the low net-velocity of the ejected water with respect to the rest system.

As the thrust in this system is pulsating a few times per second, such pulsations might be annoying. To avoid this, one of several options can be employed. One is to mount the entire system on a separate boat compartment which could slide with respect to the main boat frame. Springs and dashpots could then be used to isolate the pulsations from the main frame boat. Another option is to use more than one pumping system in the boat, each with the same frequency, but with different pump-phases chosen to smooth-out the thrust. The emerging multiple jets of water would then be more close to a continuous stream of water out the back end.

DESCRIPTION OF THE DRAWINGS

FIG. (1) is a quasi-diagrammatic side-elevation drawing of the invention illustrating the essential parts of the propulsion system.

FIG. (1A) is a sketch showing the geometry of the exiting slug of water with respect to the boat shape after the exit port valve has closed. Note that $V_w$ is the velocity of the exiting water jet slug with respect to the rest water.

FIG. (2) is a top view of the exiting water jet slug as it is intercepted by the reverse-thrust vane to turn its direction around. For normal forward direction operation of the boat, said reverse thrust vane is nominally mounted just out of position to intercept the said water jet slug.

FIG. (2A) is a side view of FIG. (2).

FIG. (3) is a system diagram showing the various parts and their relationships.

Refer next to FIG. (1) and (1A).

Element (1) is an engine, (2) represents a transmission system with its speed reduction means, (3) is a reciprocating air-pump shown here as a diaphragm-pump, (4) is a gas-tight or "internal flight-chamber", (5) is an intake port valve, shown here as a hinged scoop, driven at the proper time to launch water at the proper launch-trajectory so that the internal trajectory at the cruising speed conforms well with the shape and length of the vacuum-chamber. At other speeds the natural trajectory of the water slug, including the effects of surface tension, makes its geometric cross-sectional-extent sweep out a shape which interferes with the walls of the chamber as little as possible.

(6) is an exit port valve which is opened just before the front of the flying slug of water reaches it.

(7) represents a pressure transducer which monitors the internal pressure in the flight chamber and generates means to effect the cycle employed.

(8) is a boat-speed sensor which also generates means to effect the cycle employed.

Figure 1:
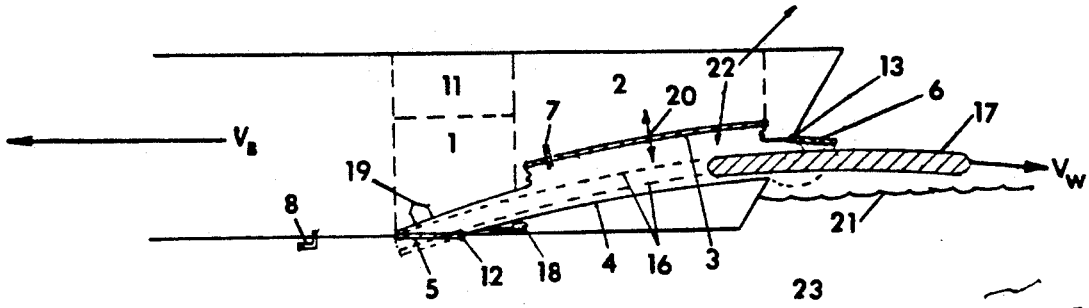
Figure 1A:
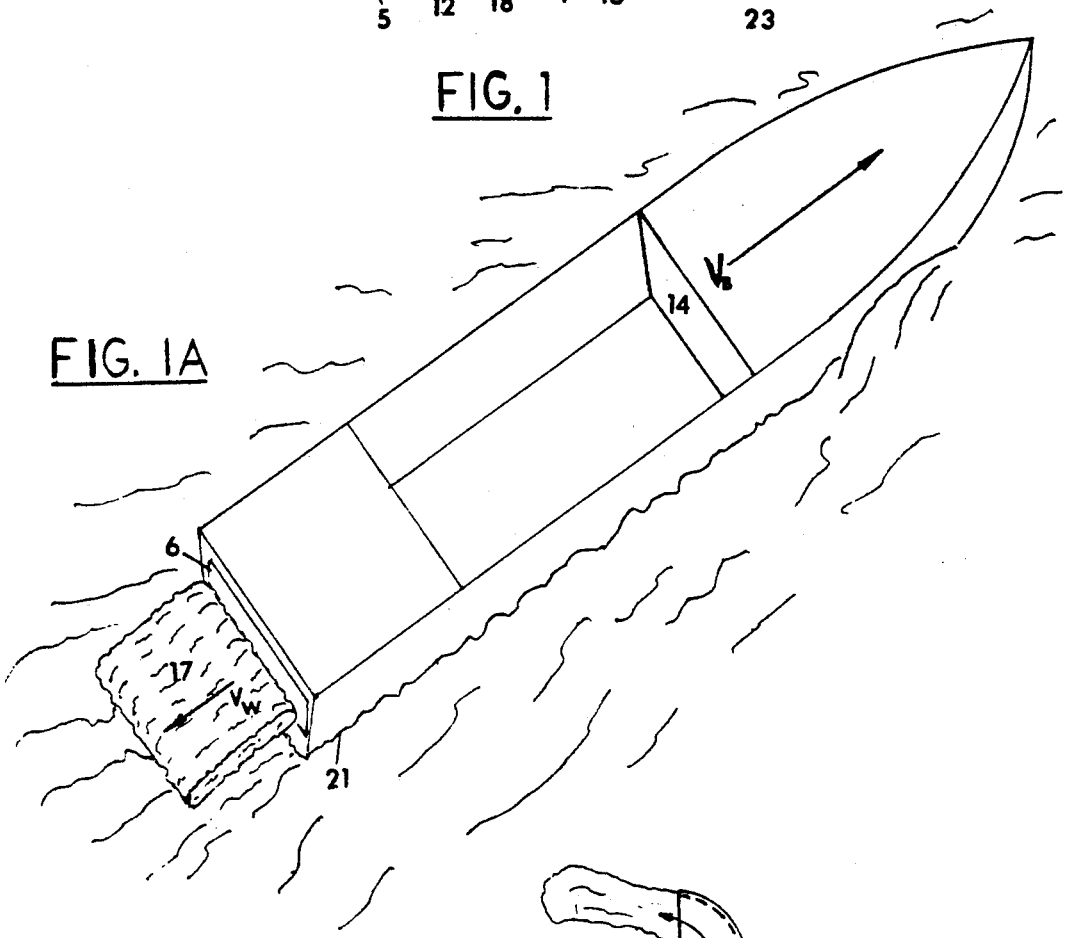
Figure 2:
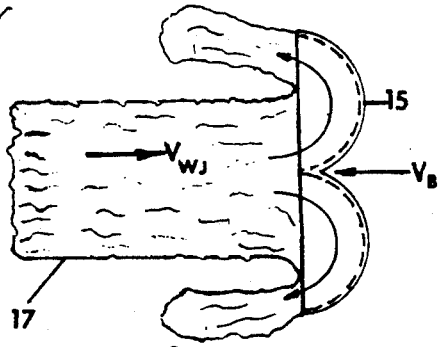
Figure 2A:
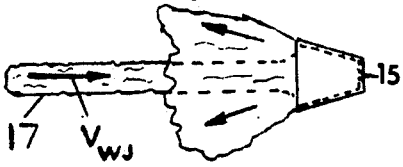
Figure 3:
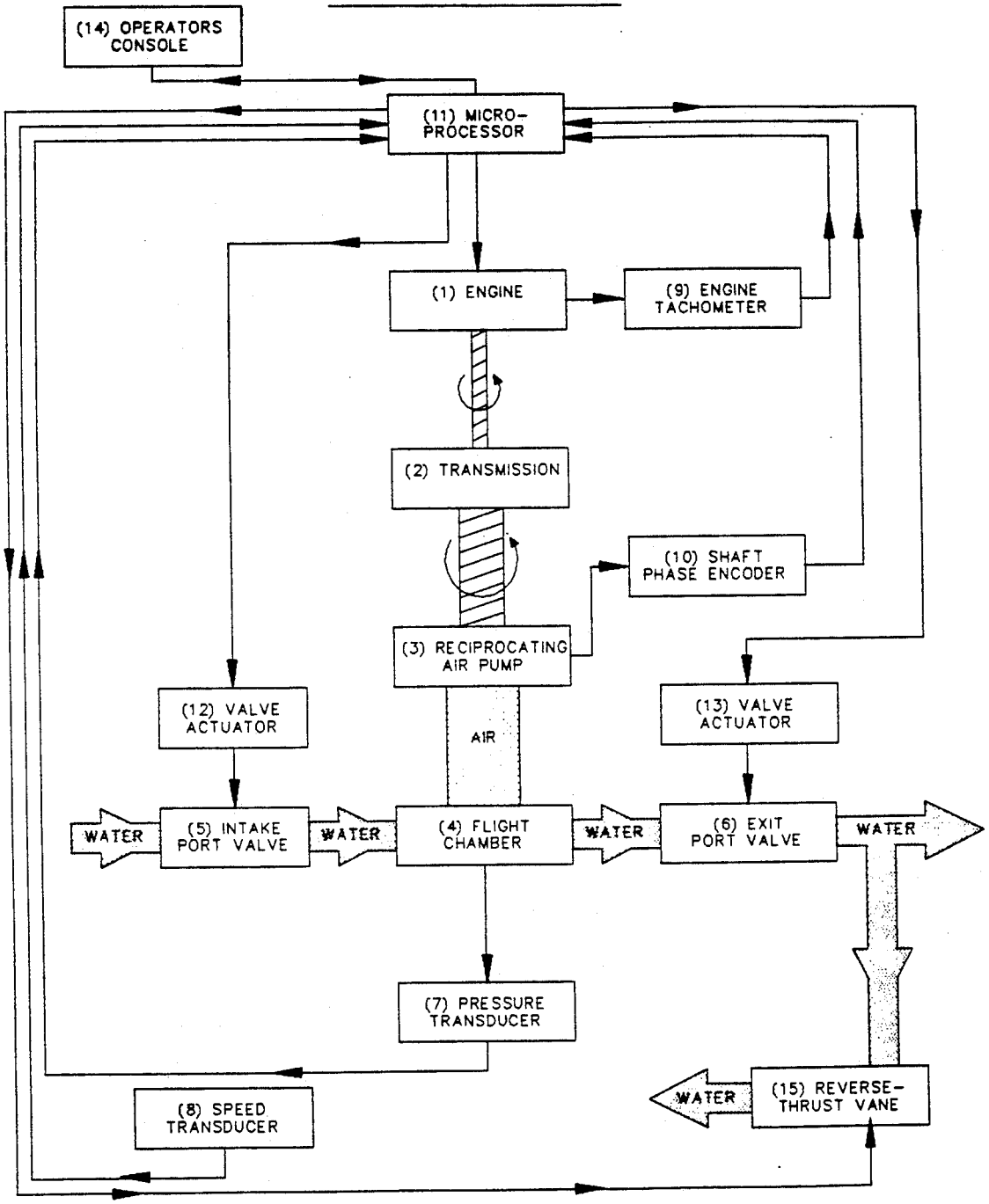

(9) is an engine-speed sensor and throttle-valve controller. (Not shown in FIG. 1, but also employed to generate means to effect the cycle employed.)

(10) is a phase-sensor which yields the position of the pump diaphragm or piston. (Not shown in FIG. 1, but also employed to generate means to effect the cycle employed.)

(11) is a controller which operates the entire system. (For example, valve actuators (12), and (13) must open and close at the proper times which depend on the boat speed, the engine speed, and the desires of the operator for efficiency or maximum thrust).

(14) is an operators speed-control transducer which is hand or foot operated. (Shown in FIG. (1A))

(15) is a boat reverse-thrust vane which re-directs the said jet of flying water towards the front of said boat. This is used to push said boat backwards.

(16) represents the trajectory of said slug of water.

(17) is said jet-slug of water flying through said flight chamber.

(18) is a water pump to pump residual water out of the chamber.

(19) is an air-blower used to "blow-out" said chamber during the jet-slug emergence from the said exit port. (This air flow helps keep spray from collecting in the chamber).

(20) Represents the motion of the said diaphragm or piston in the air-pump.

(21) The said water line.

(22) Air

(23) Water $V_B$ is the boat velocity with respect to the static water in which the boat is moving. $V_W$ is the velocity of the said exiting jet-slug of water with respect to the said static water in which the said boat is moving. Note that for high propulsion efficiency $V_W$ should be as small as possible. The propulsion efficiency is the ratio of the power actually delivered to the task of moving said boat through said water divided by the power from said engine.

Refer next to FIG. (3). This system diagram shows the connectives between the various components. The engine drives the reciprocating air-pump through a speed reducer with a reduction of the order of 20:1. Thus if the said engine was operating with a rotational speed of 3000 rpm, the said air-pump would be cycling at a rate of 150 rpm or 2.5 Hz. The said air-pump could be built in many different mechanical configurations. One favored configuration is a bellows pump in which a large diameter metal shaped-diaphragm is connected to the flight-chamber with short flexible bellows having a stroke of perhaps 1 to 2 inches. As the inside to outside pressure difference does not exceed about ½ atmosphere, bellows made of rubber or rubber-plastic combinations would be quite suitable.

The required mechanical force to move such a diaphragm is large. Typically of the order of a 5000 or more pounds-force for a system on a 15×3.5 foot boat. A cable-drive might be a typical example of the connective means between the output of the speed reducer and the pump, in that the possible mechanical arrangements between the speed reducer and the diaphragm are very flexible with a cable-drive. Clearly, a stiff mounting system would be required.

Such a drive might be driven by a simple crank which would result in a sinusoidal air pump volume versus time relationship. This would result in a pressure which was changing constantly in the flight chamber. As a result the velocity of the internal water jet would not be constant.

In a preferred mechanization, the mechanical drive means would be a cam or similar mechanical arrangement in which the pump displacement would be determined by the cam shape so as to produce an essentially constant pressure within the flight chamber all during the admission portion of the cycle.

I claim:

1. A propulsion system for watercraft having front and rear ends and moving through water partly above and partly below a water line, the watercraft having a prow at the front end and a stern at the rear end, said propulsion system comprising:

(a) front, rear, top, bottom and side region walls defining a flight chamber, said chamber having an opening in said top region wall;

(b) cyclic air pump means capable of reducing air pressure inside said flight chamber relative to atmospheric air and restoring said flight chamber air pressure back to atmospheric pressure;

(c) a second opening near to or in said front wall of the flight chamber and beneath that water line of the watercraft, said second opening being controlled by intake valve means;

(d) a third opening at the rear wall of the chamber and above the water line of the watercraft, said third opening being controlled by exit valve means;

(e) said cyclic air pump means and said intake and exit valve means being controlled by controller means to create a controlled length of free-flying jet slug of water through air inside said flight chamber, said jet slug entering through the second opening and exiting through the third opening to propel the watercraft.

* * * * *